US005161377A

United States Patent [19]

Müller et al.

[11] Patent Number: 5,161,377

[45] Date of Patent: Nov. 10, 1992

[54] METHOD AND SYSTEM FOR GENERATING ENERGY UTILIZING A BLEVE-REACTION

[76] Inventors: Rudolf Müller, Chemin du Ciclet, CH-1860 Aigle; Eike J. W. Müller, Weinbergstrasse 2c, CH-6300 Zug, both of Switzerland

[21] Appl. No.: 798,097

[22] Filed: Nov. 26, 1991

[30] Foreign Application Priority Data

Dec. 7, 1990 [CH] Switzerland ..... 03875/90

[51] Int. Cl.[5] ..... F01K 25/00

[52] U.S. Cl. ..... 60/653; 60/651; 60/671; 60/721; 60/645

[58] Field of Search ..... 60/643, 645, 651, 671, 60/670, 673, 721, 653

[56] References Cited

U.S. PATENT DOCUMENTS 4,292,358 9/1981 Fryer et al. ..... 428/135

4,930,651 6/1990 Szego ..... 220/88.1

OTHER PUBLICATIONS

Robert C. Reid, "Superheated Liquids", *American Scientist*, vol. 64 (Mar./Apr. 1976).

*Primary Examiner*—Allen M. Ostrager

*Attorney, Agent, or Firm*—Speckman & Pauley

[57] ABSTRACT

A method and installation for generating energy using the BLEVE (Boiling Liquid Expanding Vapor Explosion) reaction wherein condensate is pumped from an expansion chamber and is fed to a first heat exchanger. There, the liquid gas is heated in a first step to a certain temperature. The liquid gas is heated in a second heat exchanger with a safety valve to a higher temperature and, while expanding, is introduced via a pre-expansion valve, at the end of a feed line, to a BLEVE-reaction chamber. The BLEVE-reaction takes place in the reaction chamber, during which gas is released and supplied via the outlet pipe to a gas turbine. The gas turbine drives a generator. The turbine and the generator may be housed in the closed expansion chamber. The cycle of the method is controlled by means of a regulating control. The method described is particularly suited for a thermal power plant, the waste heat of which is transformed into electricity.

16 Claims, 2 Drawing Sheets

METHOD AND SYSTEM FOR GENERATING ENERGY UTILIZING A BLEVE-REACTION

BACKGROUND OF THE INVENTION

1. Field of the Invention

This invention relates to a method for generating energy, utilizing the BLEVE (Boiling Liquid Expanding Vapor Explosion) reaction and to a system for practicing the method.

2. Description of Prior Art

Presently, thermodynamic energy is generated in accordance with two known methods. With one of these methods, superheated steam is generated and subsequently expanded continuously in single-stage or multi-stage turbines. With the other method, energy is generated in explosion-combustion apparatuses. These two methods are sufficiently known to those skilled in the art and are not described further.

A new effect was encountered because of several explosion accidents and has been described by a number of scientists, but a sufficient physical explanation has not yet been found. This effect is known by the acronym BLEVE, in the applicable technical literature, which stands for Boiling Liquid Expanding Vapor Explosion. One of the most important articles in this respect was published by Prof. Robert C. Reid of the Massachusetts Institute of Technology (MIT) in *American Scientist*, Vol. 64 (Mar./Apr. 1976). Robert C. Reid describes in his article entitled "Superheated Liquids" the present knowledge regarding the so-called BLEVE-reaction. Mr. Reid describes a simple experiment using a bubble column, around which a heating wire is wound, the number of windings per unit of length of which increases towards the top. A host liquid contained in this bubble column is heated. A drop of a test liquid is injected into a bottom portion of the column. At the bottom of the column, the host liquid is heated to a temperature just below the boiling point of the test liquid while the temperature at the top portion of the bubble column is far above the boiling point of the test liquid. The drop of the test liquid rising in the bubble column thus is heated above its boiling point into a superheated range. Nucleation cannot take place, because there are no impurities in the host liquid and thus bubbles required for evaporation are not formed. As the drop of the test liquid continues to rise within the bubble column, it is superheated and an unexpected and complete explosion occurs.

The same effect can also be achieved with a liquid gas by heating it under pressure close to a saturated steam level and then allowing it to expand suddenly while maintaining a constant temperature, which leads to a violent explosion. If the rate of pressure change in connection with the explosion of, for example, black powder is comparable to the rate of pressure change during a BLEVE-reaction, the pressure generated by a BLEVE-reaction is approximately three times as great, and the reaction time during the pressure increase and decrease is only one-tenth of the reaction time for a conventional explosion. While, with a conventional explosion, the action is over in approximately 50 milliseconds, an explosion of superheated steam only takes approximately three milliseconds.

In spite of many tests and experiments, the BLEVE-reaction has not been used to generate energy.

SUMMARY OF THE INVENTION

It is one object of this invention to provide a method and an apparatus for practicing the method for generating energy by utilizing the BLEVE-reaction.

The first object is accomplished with a method according to one preferred embodiment of this invention wherein a liquid gas is heated in one or more steps or intervals under pressure to a saturated steam level, in a range where the saturated steam curve exceeds the superheated steam curve for the respective superheated liquid gas. The superheated liquid gas then flows under a controlled pressure and temperature into a reaction chamber through a throttle valve where nucleation cores are formed and the liquid gas explodes. The pressure is reduced from a range of the saturated steam curve to the superheated steam limit. The gas released during the explosion is then passed through an energy-generating or expansion device. According to a preferred embodiment of this invention, the apparatus used to practice the method includes a pump that aspirates condensate of the gas from an expansion chamber, which has the lowest pressure of the system. The condensate is pressurized and fed to a first heat exchanger through which the liquid gas flows and the condensate is heated. The condensate then is fed to a second heat exchanger where it is further heated and fed to a pre-expansion valve at a reaction chamber. The BLEVE-reaction occurs within the reaction chamber and the products from the explosion are discharged to a turbine within the expansion chamber. To prevent gas losses, the method can be executed in a closed loop system. Further advantageous embodiments of the method and apparatus are discussed below.

The attached drawings are intended to explain the method and the apparatus for practicing the method.

DESCRIPTION OF PREFERRED EMBODIMENTS

Figure 1:
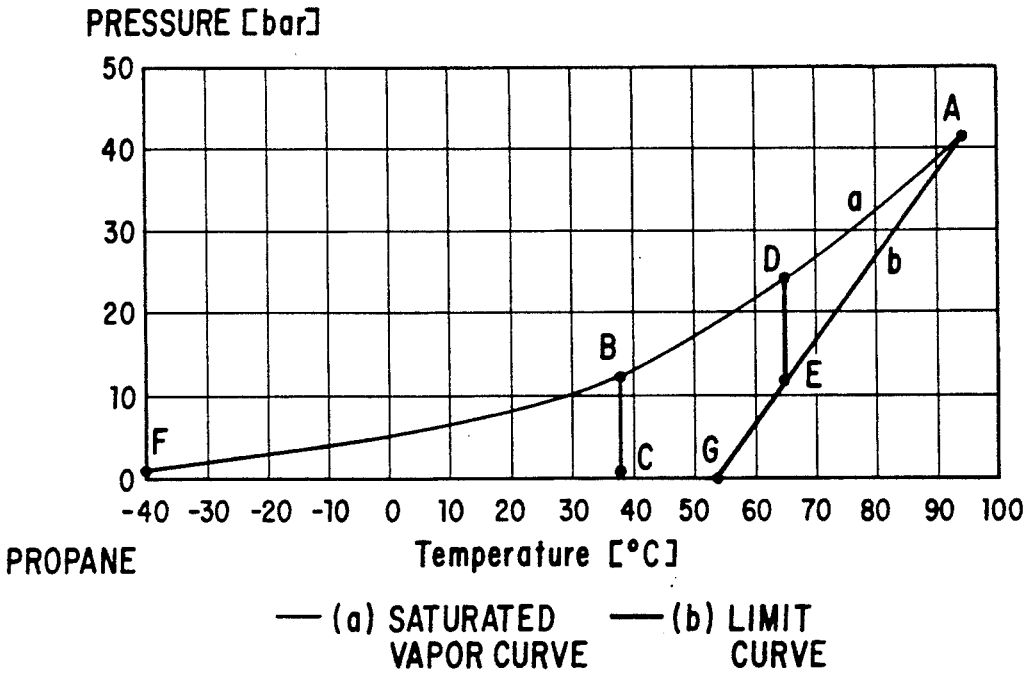
FIG. 1 is a temperature-pressure diagram showing the cycle of the method.
Figure 2:
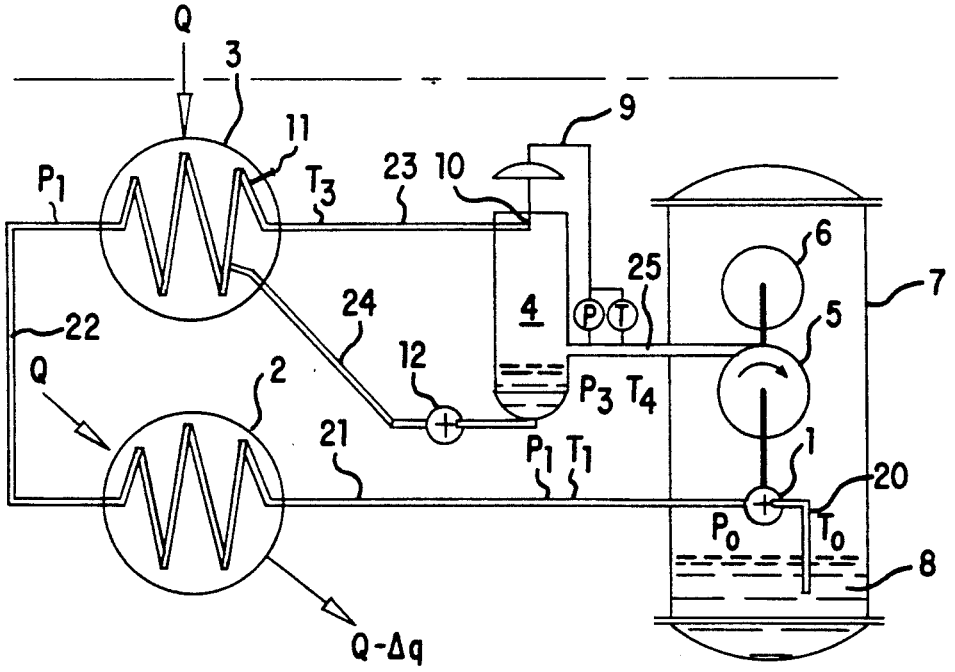
FIG. 2 is a schematic diagram of the system according to one preferred embodiment of this invention.

The physical cycle, of steps for the system as shown in FIG. 2, is shown in the temperature-pressure diagram of FIG. 1. This temperature-pressure diagram has been prepared for propane. The curve shown in FIG. 1 that is represented by a relatively thin line is the saturated steam curve "a". It starts at point F at a pressure of 1 bar and a temperature of approximately −40° C. From point A, the pressure and temperature rise continuously along a curve to the highest point A at a pressure of about 42 bar and a temperature of about 95° C. A steeper curve "b", located below curve "a" and extending in a straight line represents the so-called limit curve. More correctly, this limit curve is referred to as the superheated limit curve. It starts at a pressure of 1 bar and a temperature of about 52° C. and linearly rises to the previously mentioned point A at a pressure of 42 bar and a temperature of about 95° C. Above the saturated steam curve "a" up to the point A, the propane is gaseous but not superheated, but no liquid is present above the point A, and this is called a supercritical state. Below the limit curve "b", the propane is present in the form of a superheated gas. In the area between the two curves "a" and "b" the propane is present in liquid form.

If the propane is heated to a temperature of about 40° C. at a pressure of about 12 bar, which corresponds approximately to the point B in the diagram of FIG. 1, it is possible to arrive at the point C by a sudden pressure reduction. But it is impossible to change the propane into the range of a superheated gas by simply reducing the pressure, because the so-called limit curve cannot be exceeded here. This is only possible by heating to above 53° C. at a pressure above 20 bar.

In the method according to one preferred embodiment of this invention, the propane is preferably heated to about 65° C. and the pressure is increased to about 25 bar, which corresponds approximately to the point D in the diagram of FIG. 1. By means of a sudden pressure reduction to about 10 bar, while maintaining the temperature constant, the point E on the superheating limit curve is reached. This so-called reaction expansion from point D to point E triggers the corresponding BLEVE-reaction. A gas-fluid mixture of high-speed is generated in this step of the cycle, which can be transformed into dynamic and static pressure in a Venturi tube, where the fluid is deposited as condensate and the gas is routed over a turbine for operating expansion. The gas expands, cools and condenses until it returns to the initial point A.

This theoretical cycle occurs in a system in accordance with FIG. 2. Starting in an expansion chamber 7, where propane is present at the bottom in the form of condensate 8, it is aspirated or pumped by a pressure pump 1 via a suction pipe 20 and is routed to a first heat exchanger 2 via a pressure line 21. At the first heat exchanger 2, an amount of heat Q is added and the propane is heated to a temperature of about 40° C. to 50° C. A pressure $p_1$ of about 30 bar builds in the pressure line 21 at a temperature $T_1$ of about −20° C. The same pressure $p_1$ and an increased temperature $T_2$ of about 40° C. to 50° C. is achieved in a downstream feed line 22.

Heat Q is again added in a downstream second heat exchanger 3 until the propane has reached a temperature $T_3$ of about 60° C. to 70° C. The liquid propane reaches a pre-expansion valve 10 via a feed line 23 in which the temperature $T_3$ is achieved, from where the propane flows at a pressure of about 25 bar and reaches the BLEVE-reaction chamber 4, or a Venturi tube not shown in the drawings, where a pressure $p_2$ of about 7 to 17 bar is achieved. In the course of expansion, nucleation bodies in the amount of about one million per $mm^3$ per msec are formed, which subsequently initiates the BLEVE-reaction, where a large amount of gas and a small portion of condensate are generated. The condensate collected in the bottom of the BLEVE-reaction chamber 4 is returned via the return line 24 to the second heat exchanger 3 by means of a pressure pump 12 and is again heated to the previous temperature $T_3$.

The propane gas flows via an outlet pipe 25 out of the BLEVE-reaction chamber 4 to a gas turbine 5, which is operationally connected with a generator 6. If appropriately encapsulated, the gas turbine 5 as well as the generator 6 can be housed within the closed expansion chamber 7. The gas flowing from the gas turbine 5 is again cooled and is deposited as condensate 8, and the cycle then restarts from the beginning. The pressure pump 1 can also be operated by means of the gas turbine 5. The pressure $p_3$ and the temperature $T_4$ in the outlet pipe 25 are constantly monitored and the pre-expansion valve 10 is correspondingly controlled as a function of the pressure $p_3$ and the temperature $T_4$ by a regulating controller or regulator 9.

The efficiency of the system, shown in its simplest form in FIG. 2, can be improved and the continuity of the operation can reach a higher degree if the system further comprises a closed secondary loop. This also requires some changes in the primary loop so as not to change the method according to this invention.

Figure 3:
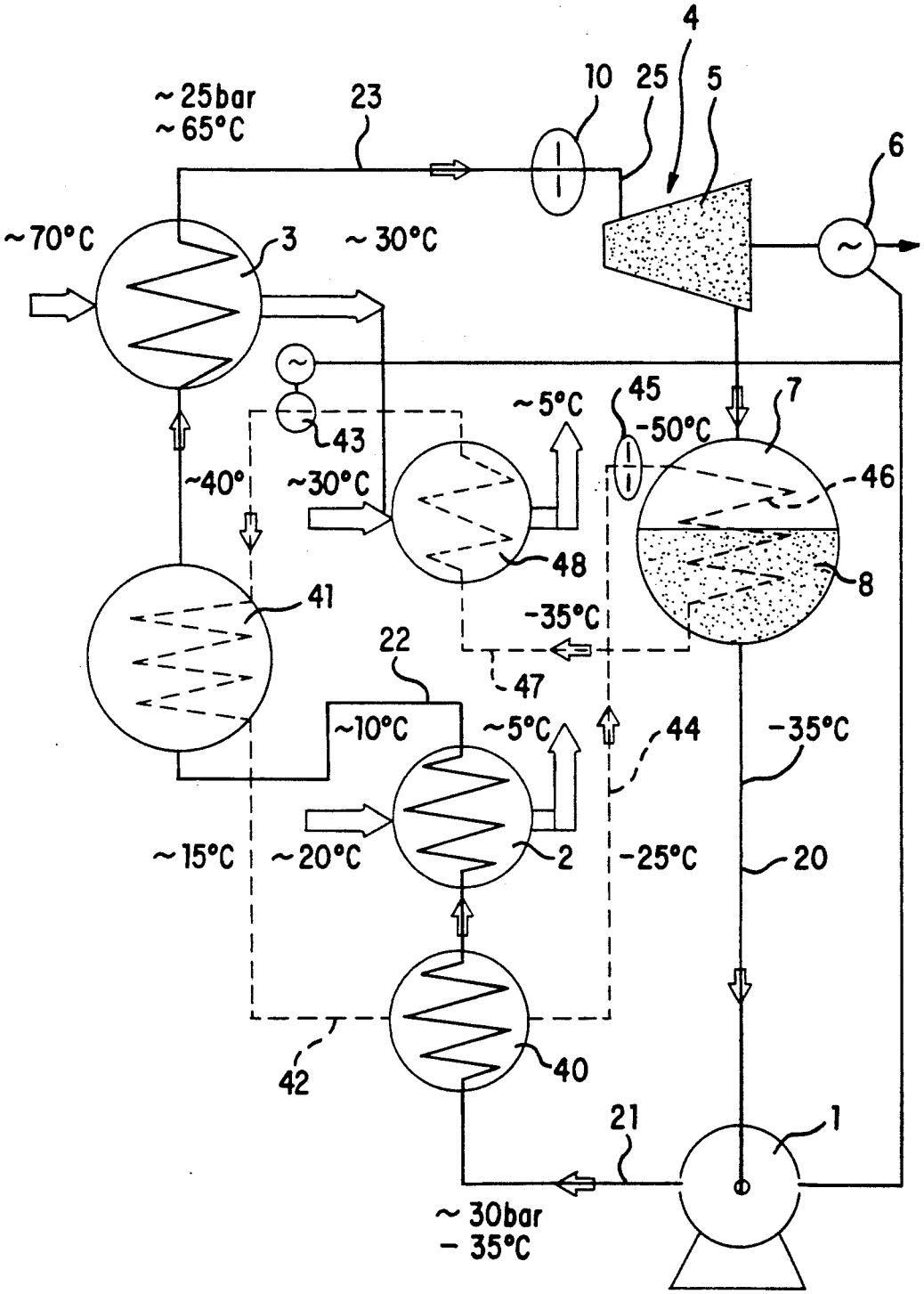
FIG. 3 shows a process flow diagram of the system as shown in FIG. 2 with an additional secondary loop.

Referring to FIG. 3, the primary loop is again briefly described with essentially only the changes emphasized. The reference numerals of unchanged elements are retained. Again, the propane gas condensate 8 is fed into the pressure line 21 from the expansion chamber 7 via the suction line 20 and the pressure pump 1. Although the propane leads to the heat exchanger 2 as before, it first flows through an intermediate heat exchanger 40 in which the compressed liquid propane gas is preheated prior to further heat input in the heat exchanger 2. Via the feed line 22, the medium which is heated to about 40° C., flows to a further heat exchanger which is similar to the second heat exchanger 3 of the previously described system of FIG. 2. However, a further heat transfer location or heat exchanger 41 is positioned between the primary loop and the secondary loop. Here the medium of the primary loop is heated from about 10° C. to about 40° C. Via the feed line 23 the liquid propane gas flows from the second heat exchanger 3 to the pre-expansion valve 10 and from there again via an outlet pipe 25, which does not empty into a concrete BLEVE-reaction chamber, into a reaction chamber which is integrated into a Kapiza turbine or an intermittently operating Wankel engine. From there the discharged gas again flows back to the expansion chamber 7. Thus, the pressure pump 12 and the return line 24 as shown in FIG. 2 can be omitted, because the non-reacting condensate reaches the expansion chamber 7 directly.

The secondary loop, which will now be further described, operates with no BLEVE-reaction and has counterflow with respect to the flow of the primary loop. The compressed medium, preferably a cooling medium, for example propane gas, flows from a compressor unit 43 via a pressure line 42 to the already described heat transfer location or heat exchanger 41. As shown in FIG. 3, the primary loop is heated, while the medium in the pressure line 42 of the secondary loop is cooled from about 40° C. to about 15° C.

Finally, the pressure line 42 empties into the intermediate heat exchanger 40 where the medium in the secondary loop is cooled from about 15° C. to about −25° C. and thereby adds heat to the primary loop. Via a return line 44 and an expansion valve 45 in the secondary loop, the medium which is cooled to about −50° C., is heated to about −35° C. in the expansion chamber 7 by the exhaust gas flowing from the turbine 5. Before the suction line 47 again reaches the compressor unit 43 from the expansion chamber 7, this line is again routed through a heat exchanger 48 where the medium is again heated. In this embodiment, the required heat is taken from the ambient air in this heat exchanger 48 in the return of the secondary loop. It is thus possible to use the exhaust air of about 30° C. from the heat exchanger 3, or steam present in the primary loop in the form of supply air or steam, for the heat exchanger 48 in the secondary loop.

We claim:

1. A method for generating energy utilizing a BLEVE-reaction, including the steps of: heating a liquid gas in at least one step under pressure up to a saturated steam limit of said liquid gas in a range where a corresponding saturated steam curve extends above a superheated limit curve for said liquid gas in a superheated state; allowing said superheated liquid gas to flow under controlled pressure and temperature conditions into a reaction chamber via a throttle valve; and forming nucleation cores and exploding the liquid gas while reducing a pressure from a range of said saturated steam curve to said superheated limit curve, and discharging a released gas from said explosion across an energy-generating machine.

2. A method in accordance with claim 1, wherein said liquid gas is continuously circulated in a closed loop.

3. A method in accordance with claim 2, further including the steps of: increasing the pressure of said liquid gas from 1 bar to 25 bar and then heating said liquid gas to a first temperature which is below a second temperature at which a BLEVE-reaction can occur; and then further heating the liquid gas above said second temperature.

4. A method in accordance with claim 1, wherein said liquid gas is propane.

5. A method in accordance with claim 4, wherein said liquid gas is heated in a first step to about 40° C. to 50° C. and is heated in a second step to about 60° C. to 70° C.

6. A method in accordance with claim 1, wherein said liquid gas is a halogenated hydrocarbon containing at least one fluorine atom.

7. A method in accordance with claim 6, wherein said liquid gas is heated in a first step to about 40° C. to 50° C. and is heated in a second step to about 60° C. to 70° C.

8. A method in accordance with claim 1, wherein the medium follows the BLEVE-reaction at a high-speed and is transformed into dynamic and static pressure.

9. A system for generating energy utilizing a BLEVE-reaction, the system comprising: a pump aspirating condensate (8) from an expansion chamber (7), said expansion chamber (7) having a lowest operating pressure within the system, a first heat exchanger (2) having a first inlet in communication with a discharge of said pump (1), through which the liquid gas flows and is heated, a first outlet of said first heat exchanger (2) in communication with a second inlet of a second heat exchanger (3), a pre-expansion valve (10) having an upstream side in communication with a second outlet of said second heat exchanger, a reaction chamber (4) in which the BLEVE-reaction takes place, and a chamber outlet (25) of said reaction chamber (4) in communication with a turbine (5) within an expansion chamber (7).

10. A system in accordance with claim 9, further comprising a condensate pump (12) having a pump suction in communication with condensate (8) within said reaction chamber (4) and a pump discharge in communication with and between said second inlet and said second outlet of said second heat exchanger.

11. A system in accordance with claim 9, further comprising a safety valve (11) in communication with said second heat exchanger (3).

12. A system in accordance with claim 9, further comprising a regulator (9) for controlling said pre-expansion valve (10) as a function of a pressure ($p_3$) and a temperature ($T_4$) of a gas within said chamber outlet (25).

13. A system in accordance with claim 9, further comprising a heat source (Q) resulting from exhaust steam of a steam turbine, for supplying heat to said first heat exchanger (2) and said second heat exchanger (3).

14. A system for generating energy utilizing a BLEVE-reaction, the system comprising: a primary loop within which a gas required for a BLEVE-reaction is circulated, a pump (1) for pumping condensate from an expansion chamber (7) to a first heat exchanger (2) and then to a second heat exchanger (3) for pre-heating said condensate to a temperature suitable for the BLEVE-reaction, a pre-expansion valve (10) in communication with and between said second heat exchanger (3) and a reaction chamber which is an integral part of an energy-generating machine, a discharge of said energy-generating machine in communication with said expansion chamber (7); a closed secondary loop operating in a counterflow direction with respect to flow said primary loop, a compressor unit (43) within said secondary loop in communication with a third heat exchanger (41) for transferring heat from said secondary loop to said primary loop between said first heat exchanger (2) and said second heat exchanger (3) of said primary loop; an intermediate heat exchanger (40) within said secondary loop in communication with and downstream of said third heat exchanger (41) for transferring heat from said secondary loop to said primary loop, said intermediate heat exchanger (40) in communication with and between said first heat exchanger (2) and said pump (1) of said primary loop; means for passing medium of said secondary loop through condensate (8) within said expansion chamber (7) of said primary loop, and a fourth heat exchanger (48) in communication with and between said compressor unit (43) and said intermediate heat exchanger (40), downstream of said expansion chamber (7).

15. A system in accordance with claim 14, further comprising means for flowing industrial exhaust gas first through said second heat exchanger (3) of said primary loop and then through said fourth heat exchanger (48) in said secondary loop.

16. A system in accordance with claim 14, further comprising a heat source (Q) resulting from exhaust steam of a steam turbine, for supplying heat to said second heat exchanger (3).

* * * * *